US012467269B2

(12) United States Patent
Tanaka et al.

(10) Patent No.: US 12,467,269 B2
(45) Date of Patent: Nov. 11, 2025

(54) MOUNTING MEMBER

(71) Applicant: FUKUVI CHEMICAL INDUSTRY CO., LTD., Fukui (JP)

(72) Inventors: Daisuke Tanaka, Bangkok (TH); Naoya Ishida, Bien Hoa (VN); Hironori Horie, Tokyo (JP); Eiji Koutani, Tokyo (JP)

(73) Assignee: FUKUVI CHEMICAL INDUSTRY CO., LTD., Fukui (JP)

( * ) Notice: Subject to any disclaimer, the term of this patent is extended or adjusted under 35 U.S.C. 154(b) by 131 days.

(21) Appl. No.: 18/485,489

(22) Filed: Oct. 12, 2023

(65) Prior Publication Data

US 2024/0151047 A1 May 9, 2024

(30) Foreign Application Priority Data

Nov. 8, 2022 (TH) ..... 2203003051

(51) Int. Cl.
*E04G 9/10* (2006.01)

(52) U.S. Cl.
CPC ..... *E04G 9/10* (2013.01)

(58) Field of Classification Search
CPC ..... E04G 9/10; E04G 15/06; E04G 15/061; E04G 15/063; E04G 15/065; E04G 15/068
See application file for complete search history.

(56) References Cited

U.S. PATENT DOCUMENTS 1,053,257 A * 2/1913 Weakley ..... B29C 45/14065 264/316
2,064,528 A * 12/1936 Fischer ..... E01C 11/106 404/136
RE24,921 E * 1/1961 Wilbur ..... E01C 11/14 404/51
4,411,404 A * 10/1983 Weisbach ..... E01C 11/08 249/6
4,455,104 A * 6/1984 Weisbach ..... E04F 15/14 249/9
4,904,111 A * 2/1990 Weisbach ..... E04F 15/14 249/9
5,156,791 A * 10/1992 Sano ..... B28B 7/364 264/318
6,279,868 B1 * 8/2001 Eyring ..... E04G 15/068 249/35
8,573,556 B1 * 11/2013 Baker ..... E04H 17/1404 249/168
2004/0041074 A1 * 3/2004 Takagi ..... E04G 17/004 249/205

(Continued)

FOREIGN PATENT DOCUMENTS

JP 2009-144387 A 7/2009
WO WO-2024011296 A1 * 1/2024

*Primary Examiner* — Kyle J. Walraed-Sullivan
(74) *Attorney, Agent, or Firm* — WHDA, LLP

(57) ABSTRACT

To provide a mounting member comprising a ridge that is long in one direction and fixed to a desired position on a formwork in a simple manner, to form a desired groove portion in a concrete flat plate. The mounting member that is mounted on a formwork used to fabricate a concrete flat plate, and the mounting member comprises: a base material; a ridge portion that is provided on the base material and projects against an inner surface of the formwork; and a fixing portion that fixes the ridge portion to the inner surface.

10 Claims, 9 Drawing Sheets

(56) References Cited

U.S. PATENT DOCUMENTS

| | | | | |
|---|---|---|---|---|
| 2004/0079035 | A1* | 4/2004 | Takagi | E04G 17/004 52/97 |
| 2004/0118070 | A1* | 6/2004 | Takagi | B28B 7/28 52/600 |
| 2008/0023621 | A1* | 1/2008 | Wagner | E04G 15/068 249/188 |

* cited by examiner

MOUNTING MEMBER

BACKGROUND ART

Technical Field

The present invention relates to a mounting member.

Related Art

Patent Literature 1 discloses, for example, a concrete formwork accessory member including a ridge for a drainage groove that corresponds to a groove portion formed in a concrete flat plate. The accessory member is mounted on the formwork first, and then concrete is poured into the formwork and the leveling and hardening processes are performed to form a concrete flat plate with a desired groove.

PRIOR ART

Patent Literature 1: Japanese Unexamined Patent Application Publication No. 2009-144387

SUMMARY OF INVENTION

Technical Problem

However, since the ridge disclosed in Patent Literature 1 is fixed to the formwork with nails, the ridge may be inclined when the nails are positioned or nailed without the user noticing it, causing the ridge to be mounted at an undesirable position. This causes the groove portion in the concrete flat plate to be formed in a twisted manner. Thus, it has been difficult to fix the ridge that is long in one direction to the desired position in a simple manner by nailing or screwing it.

Thus, in order to solve the above-described problem of the conventional art, an object of the present invention is to provide a mounting member comprising a ridge that is long in one direction and fixed to a desired position on a formwork in a simple manner, to form a desired groove portion in a concrete flat plate.

Solution to Problem

The mounting member of the present invention is a mounting member that is mounted on a formwork used to fabricate a concrete flat plate, and the mounting member comprises: a base material; a ridge portion that is provided on the base material and projects against an inner surface of the formwork; and a fixing portion that fixes the ridge portion to the inner surface.

Comprising the fixing portion that fixes the ridge portion to the inner surface, the mounting member of the present invention that is long in one direction is fixed to a desired position on a formwork in a simple manner, thereby forming a desired groove portion in the concrete flat plate.

Preferably, the fixing portion is a clamping portion that clamps the formwork. Since the fixing portion is a clamping portion, the mounting member is easily mounted on the formwork.

Preferably, the height of the mounting member is equal to or higher than the height of the formwork. This allows to mount the mounting member at a certain position in a simple manner, without the need for positioning as a lower end portion of the mounting member makes contact with the bottom surface of the formwork when the mounting member is mounted on the formwork. In addition, since the mounting member covers the formwork in the height direction, no step portion is formed in the side surface of the concrete flat plate.

Preferably, the ridge portion includes a base area having a portion that is thinner than the other portions of the ridge portion. The ridge portion configured in this manner is removable.

Preferably, the mounting member comprises an upper end portion that is sloped. The sloped upper end portion of the mounting member reduces the contact surface between the mounting member and the leveling machine during the leveling process and prevents the leveling machine from making contact with the mounting member.

Preferred embodiments of the present invention include: the fixing portion having an adhesive surface, the formwork including a ferromagnetic body and the fixing portion being a magnet disposed between the formwork and the mounting member. Here, examples of the ferromagnetic body include iron, cobalt, nickel, their alloys, and ferrite.

Preferably, the fixing portion includes a plate spring portion and a support portion supporting one end side of the plate spring portion, and the support portion is provided at a position at which it does not make contact with an upper end surface of the formwork when the mounting member is mounted on the formwork. Since the support portion is provided at a position at which it does not make contact with an upper end surface of the formwork when the mounting member is mounted on the formwork, the mounting member is positioned relative to the bottom surface when mounted. This allows to fix the mounting member that is long in one direction to a desired position on the formwork in a simpler manner.

Preferably, the support portion has a base area that is formed to be smooth. The base area that is smooth (rounded) makes it easier to manufacture the mounting member and allows to maintain the strength of the support portion.

Preferably, the mounting member comprises a base material and the fixing portion, and the fixing portion includes an extended portion that is extended parallel to the base material and a support portion that connects and supports the extended portion and the base material. It is possible to fix the mounting member in this shape to the formwork.

Preferably, the formwork includes a ferromagnetic body and the mounting member further comprises a magnet that is adhered to the formwork by means of the mounting member. Further comprising the magnet that is adhered to the formwork by means of the mounting member, the mounting member is fixed more firmly in a simple manner when the formwork includes a ferromagnetic body.

Advantageous Effects of Invention

The present invention provides a mounting member comprising a ridge portion that is long in one direction and fixed to a desired position on a formwork in a simple manner, to form a desired groove portion in a concrete flat plate.

BRIEF DESCRIPTION OF DRAWINGS

FIG. 1 is a perspective view of a mounting member according to embodiment 1.

FIG. 2 is a cross-sectional view of the mounting member according to embodiment 1.

FIG. 3 shows the mounting member according to embodiment 1, mounted on a formwork.

FIG. 4 is a partially enlarged view of the mounting member according to embodiment 1.

FIG. 5 shows the mounting member according to embodiment 2, mounted on a formwork.

FIG. 6A shows a mounting member according to a modification example, mounted on a formwork.

FIG. 6B shows a mounting member according to a modification example, mounted on a formwork.

FIG. 7 shows a mounting member according to a modification example, mounted on a formwork.

FIG. 8A shows a mounting member according to a modification example, mounted on a formwork.

FIG. 8B shows a mounting member according to a modification example, mounted on a formwork.

DESCRIPTION OF EMBODIMENTS

Embodiment 1

Figure 1:
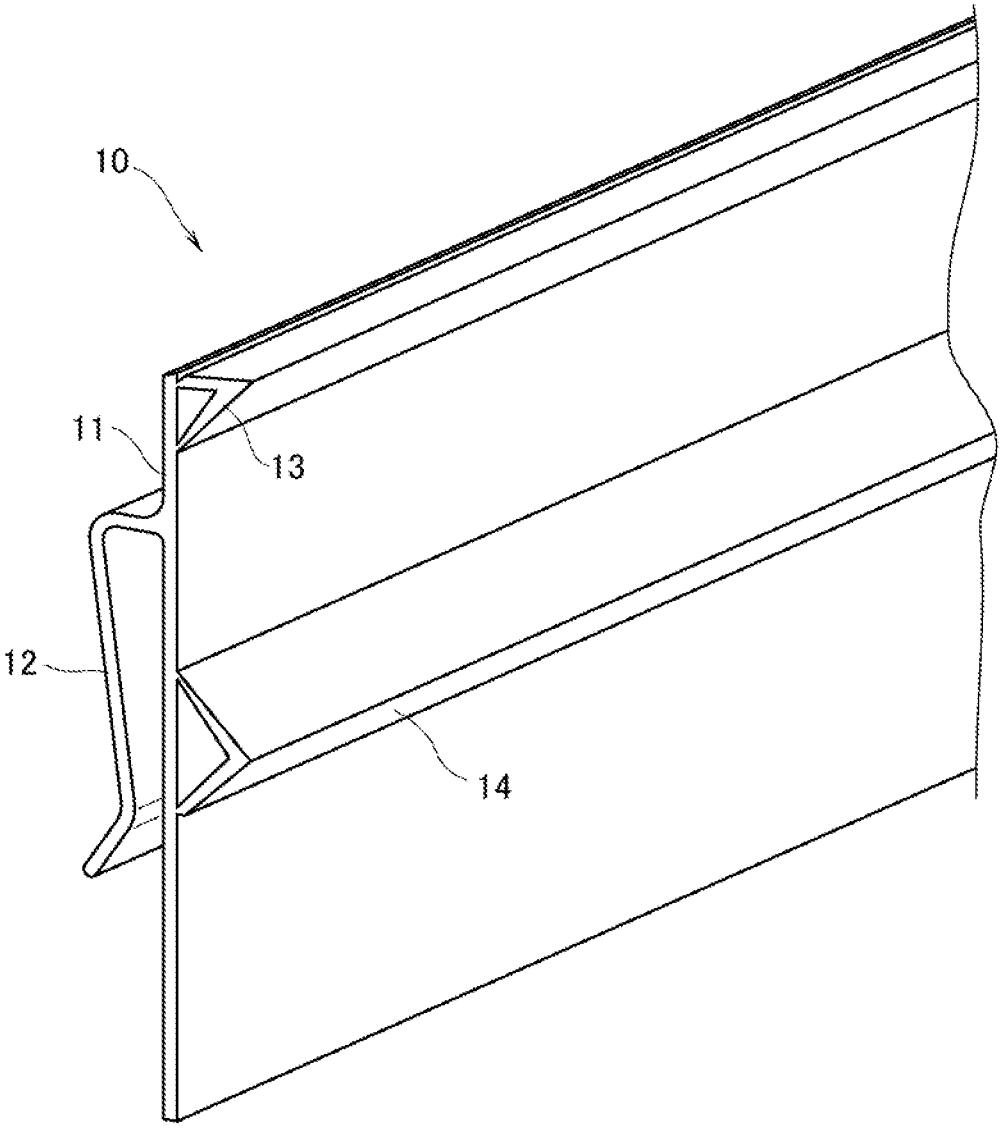
FIG. 1.
Figure 2:
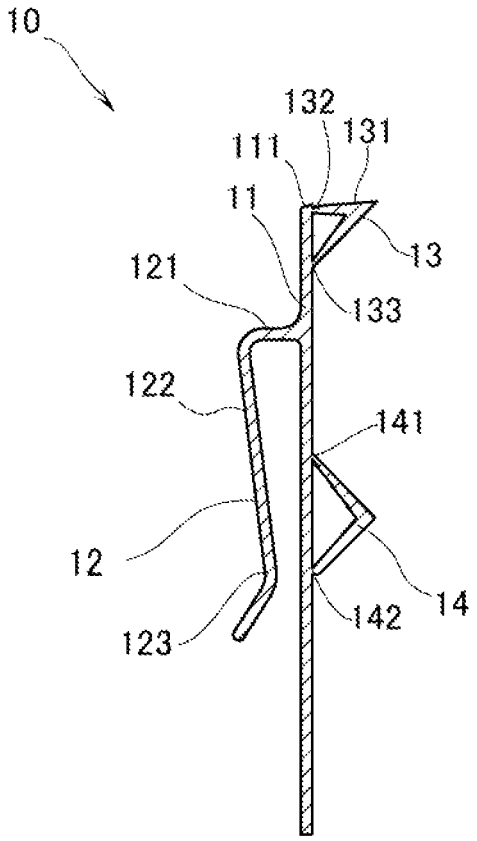
FIG. 2.
Figure 3:
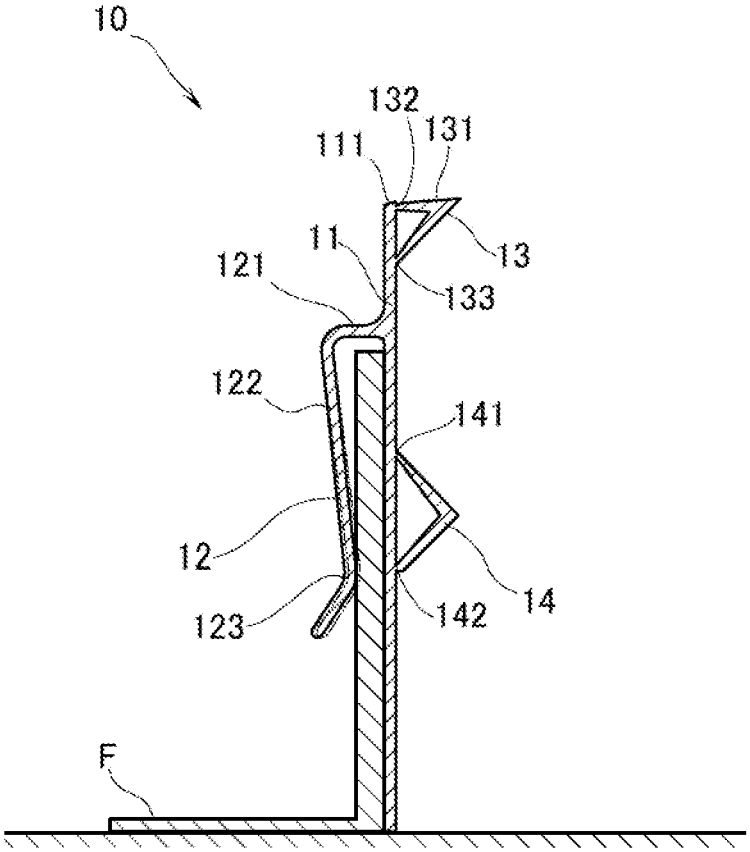
FIG. 3.
Figure 4:
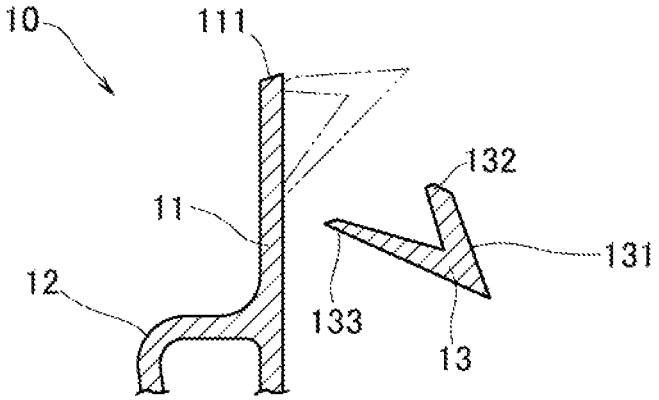
FIG. 4.

A mounting member 10 according to this embodiment will be described with reference to FIGS. 1 to 4. The mounting member 10 is long in one direction as shown in FIG. 1. When used for fabricating a concrete flat plate, the mounting member 10 is mounted on a rectangular formwork F (see FIG. 3). The formwork F of this embodiment is made of a metal. The mounting member 10 comprises: a base material 11; a fixing portion 12 extended from the base material 11 on one surface side (left side in FIG. 2) of the base material 11; and a first ridge portion 13 and a second ridge portion 14 extended from the base material 11 on the other surface side (right side in FIG. 2) of the base material 11.

The fixing portion 12, the first ridge portion 13 and the second ridge portion 14 are provided on the base material 11. The base material 11 has a plate-like shape, and its longitudinal length is equal to the longitudinal length of a side of the formwork F on which the base material 11 is disposed. In this embodiment, the height of the base material 11 is taller than the length of the formwork F covered by the base material 11 in the height direction.

The fixing portion 12 is for fixing the mounting member 10 to the formwork F. In the present invention, the fixing portion is a portion configured to fix the mounting member to the formwork without needing another member (e.g., screws, nails, etc.) and includes a support portion 121 extended from the base material 11 and a plate spring portion 122. The plate spring portion serves as a plate spring supported at one end side thereof by the support portion 121, i.e., cantilevered. The plate spring portion 122 and the base material 11 are spaced apart. A pressing portion 123 is provided at a tip end side of the plate spring portion 122. The distance between the base material 11 and the plate spring portion 122 is narrowest at the position of the pressing portion 123, and since this distance is smaller than the thickness of the formwork F, when the formwork F is inserted between the plate spring portion 122 and the base material 11, the plate spring portion 122 is biased inwardly and as a result the formwork F is clamped between the pressing portion 123 of the fixing portion 12 and the base material 11. This allows to firmly fix the mounting member 10 to the formwork F in a simple manner. In addition, the length of the base material 11 that covers the formwork F in the height direction of the formwork F, i.e., the height of the base material 11 is equal to the height of the formwork F, and thus a lower portion of the base material 11 makes contact with the bottom surface when the mounting member 10 is mounted on the formwork F, allowing the base material 11 to serve as a positioning member, and thus anyone can easily mount the mounting member 10 that is long in one direction, to be straight at a desired position. This allows to fix the mounting member 10 precisely to a desired position. In this embodiment, the mounting member 10 comprises the base material 11 that covers the formwork F in the height direction of the formwork F when the mounting member 10 is mounted on the formwork F. Provided in this manner, the mounting member 10 and the formwork F form no step therebetween, and thus no stepped portion is formed on the end surfaces of the concrete flat plate.

The base of the support portion 121 is connected to the base material 11 smoothly with a rounded structure (or rounded). This configuration allows for easy manufacturing and maintaining the strength of the support portion 121.

The first ridge portion 13 and the second ridge portion 14 are shaped to correspond to a groove portion formed in the concrete flat plate in a desired manner. When the mounting member 10 is mounted on the formwork F by means of the fixing portion 12 as described above, the first ridge portion 13 and the second ridge portion 14 are disposed on the inner surface of the formwork F, which allows to form a desired groove portion in the concrete flat plate obtained by pouring concrete into the formwork F. In this embodiment, both the first ridge portion 13 and the second ridge portion 14 are shaped to form a substantially triangular shape with the base material 11 in cross-sectional view, thereby forming groove portions that are substantially triangular in cross-sectional view in the concrete flat plate.

The first ridge portion 13 is disposed at a position higher than the formwork F. Mounting this mounting member 10 on the formwork F allows to fill concrete up to the upper end of the mounting member 10, thereby forming a thicker concrete flat plate. Thus, there is no need to mold another formwork F to form a thicker concrete flat plate. The first ridge portion 13 has a ceiling portion 131 formed with a sloped surface. Specifically, the ceiling portion 131 has an upper surface that is slightly lower on the left side relative to the right side in FIGS. 2 to 4. The base material 11 has, at its upper end, an upper end surface 111 that is a sloped surface. In other words, the upper end surface 111 is slightly lower on the left side relative to the right side in FIG. 2. In this embodiment, the members that constitute the upper end portion of the mounting member 10, i.e., the ceiling portion 131 and the upper end surface 111 of the base material are formed as sloped surfaces, and thus the contact surface between the mounting member 10 and the leveling machine is reduced when leveling the surface of the concrete flat plate, which prevents the leveling machine from making contact with the mounting member 10.

The mounting member 10 is formed of resin by integral molding. The resin to be used may be thermoplastic resin, especially olefinic resin such as rigid polyvinyl chloride, polypropylene and polyethylene.

In this embodiment, the first ridge portion 13 includes connecting portions 132, 133 to the base material 11, and the connecting portions 132, 133 are thinner than the other portions of the first ridge portion 13. The second ridge portion 14 includes connecting portions 141, 142 to the base material 11, and the connecting portions 141, 142 are also thinner than the other portions of the second ridge portion 14. Specifically, the thickness of the connecting portions 132, 133 and 141, 142 is 0.1 mm to 1.0 mm, preferably 0.3 mm to 0.9 mm, and most preferably 0.5 mm to 0.7 mm. When their thickness is thinner than 0.1 mm, the possibility of damage to the connecting portions 132, 133 and 141, 142 due to shock or stress caused in transportation, etc. increases, whereas when their thickness is thicker than 1.0 mm, removal thereof may be difficult. The first ridge portion 13 and the second ridge portion 14 are removable from the base material 11 because the connecting portions 132, 133, 141, 142 are thinner than the other portions (In FIG. 4, only the first ridge portion 13 is enlarged to explain the connecting portions).

In other words, the first ridge portion 13 and the second ridge portion 14 of this embodiment are removed in a simple manner according to the shapes of the desired concrete flat plates. The first ridge portion 13 and the second ridge portion 14 configured in this manner eliminate the need to fabricate mounting members according to the numbers of desired groove portions in the concrete flat plates, and allow to fabricate concrete flat plates of various shapes using a mounting member of a single shape. In this embodiment, both the first ridge portion 13 and the second ridge portion 14 are removable, but the present invention is not limited to this, and only one of them may be removable.

Embodiment 2

Figure 5:
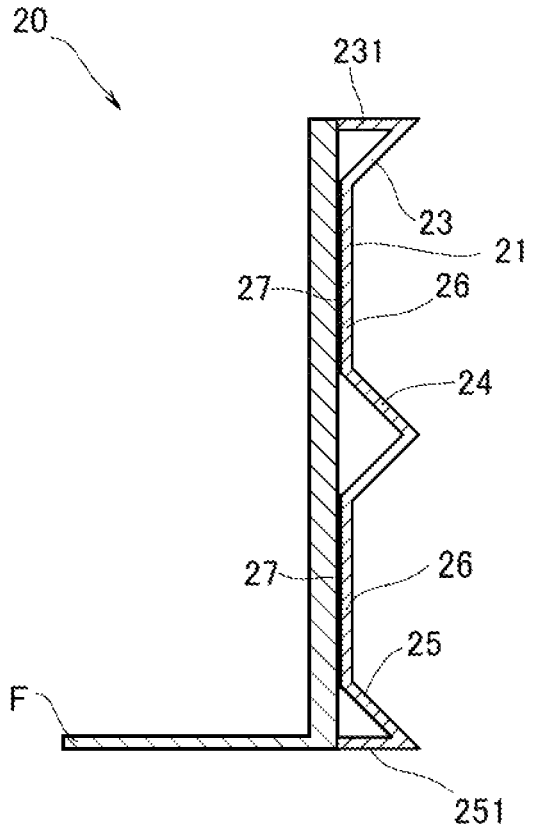
FIG. 5.

Now, a mounting member 20 according to this embodiment will be described with reference to FIG. 5. The mounting member 20 of this embodiment comprises a plurality of bent portions that are formed in a base material 21 itself to project on one side of the base material 21, which are referred to as a first ridge portion 23, a second ridge portion 24 and a third ridge portion 25. The first ridge portion 23 includes a ceiling portion 231 as in the first ridge portion 13 of embodiment 1.

This embodiment comprises flat plate portions 26 formed between the first ridge portion 23 and the second ridge portion 24 and between the second ridge portion 24 and the third ridge portion 25 of the base material 21. On the other side of the flat plate portions 26 of the base material 21, fixing portions 27 formed of double-sided tape are provided. In other words, in this embodiment, the mounting member 20 is fixed, by adhesion, to the inner surface of the formwork F using the fixing portions 27 that are double-sided tape provided on the flat plate portions 26 of the base material 21. As described here, the mounting member 20 may also be mounted at a desired position on the formwork F in a simple manner, by means of the fixing portions 27 formed of double-sided tape. Furthermore, the third ridge portion 25 of this embodiment includes a bottom portion 251 that is parallel to the floor of the formwork F and the height of the base material 21 is equal to that of the formwork F, and thus the bottom 251 serves as a positioning member, thereby allowing to fix the mounting member 20 to a desired position on the formwork F in a simple manner.

The fixing portion 27 of this embodiment is only required to fix the mounting member 20 to the formwork F in a simple manner, and a magnet or the like also may be used as the fixing portion 27 to fix the mounting member 20 to a formwork F, formed of a ferromagnetic metal. Also, adhesive tape having an adhesive surface formed on one surface side of the tape may be used as the fixing portion 27. In this case, an adhesive layer may be separately formed on the other surface side of the adhesive tape, to be attached to the flat plate portion. The ceiling portion 231 may be configured as a sloped surface.

Modification Examples

In embodiments 1 and 2 described above, the ridge portions have a triangular shape in cross-sectional view, but the present invention is not limited to this, and the ridge portions may be configured according to the shapes of the desired groove portions in concrete flat plates.

Figure 6A:
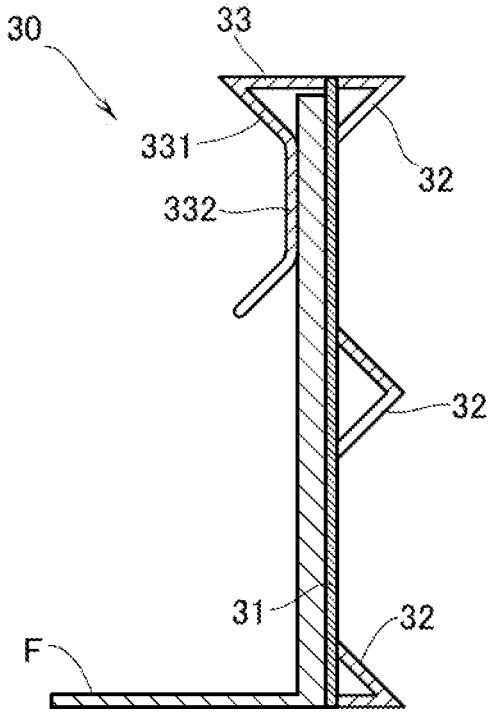
FIG. 6A.

For example, a mounting member 30 which is a modification example shown in FIG. 6A comprises ridge portions 32 that are provided at three positions on a base material 31 and have the same shape as the first ridge portion 23 to the third ridge portion 25 of the mounting member 20 of embodiment 2. The mounting member 30 differs from the mounting member 20 of embodiment 2 in that the ridge portions are formed without bending the base material 31. The ridge portions 32 provided on the base material 31 in this manner are removable from the base material 31, and the overall strength of the mounting member 30 is increased compared to the mounting member 20 of embodiment 2. As in embodiment 1, the mounting member 30 comprises a plate spring portion 331 that is provided on the base material 31 as a fixing portion 33 and serves as a clamping portion, but the area pressed by its pressing portion 332 is wider than in embodiment 1. The fixing portion 33 of the mounting member 30 may be formed on the base material 31 with fixing means such as double-sided tape, as in embodiment 2.

Figure 6B:
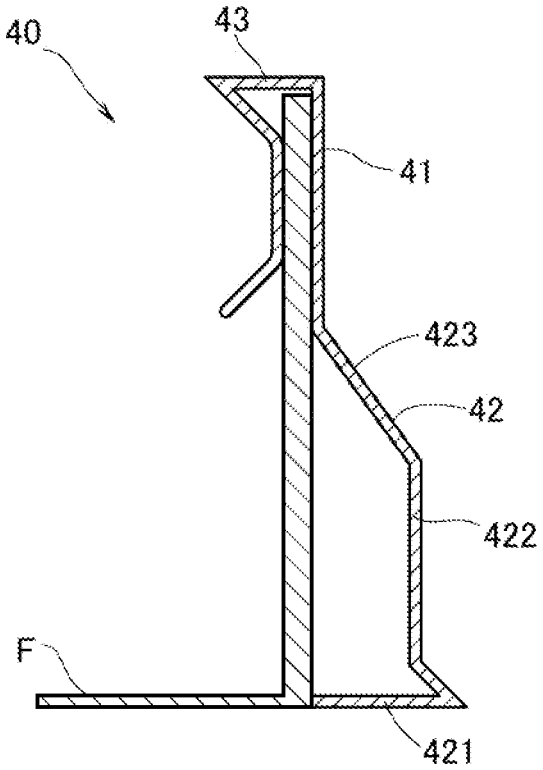
FIG. 6B.

In a mounting member 40 that is a modification example shown in FIG. 6B, a ridge portion 42 is formed by forming a bent portion in a base material 41 itself to project on one side of the base material 41, in order to form a groove portion that is trapezoidal in cross-sectional view. The ridge portion 42 includes a bottom portion 421, a side wall portion 422 and a sloped surface portion 423 that are continuously provided, with the bottom portion being the height of the substantially trapezoidal shape in cross-sectional view and the side wall portion 422 being its upper side. The base material 41 includes a fixing portion 43 provided as a clamping portion on the opposite side of the ridge portion 42 of the base material 41.

Figure 7:
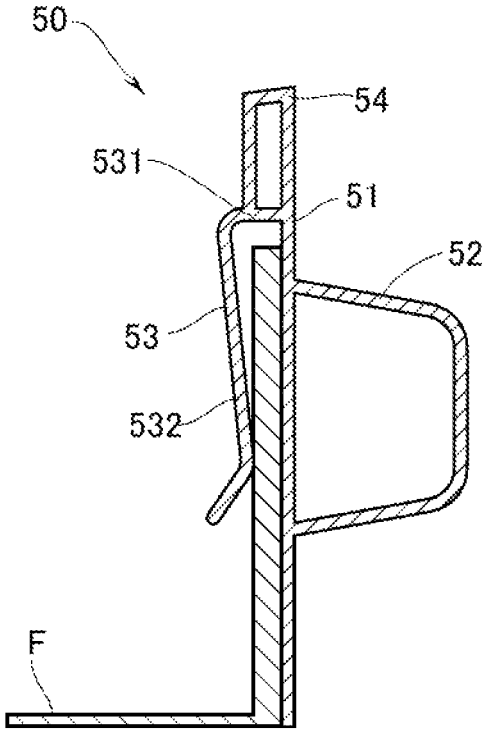
FIG. 7.

In order to form a groove portion that is trapezoidal in cross-sectional view, a mounting member 50 shown in FIG. 7 comprises a ridge portion 52 provided near the center of the base material 51 with respect to the height direction. As described here, the ridge portion may be formed as required according to the shape of the desired groove portion in the concrete flat plate. The base material 51 includes a fixing portion 53 that is a clamping portion, and the fixing portion 53 has a support portion 531, at an upper portion of which a holding portion 54 is provided to be rectangular in cross-sectional view. With the holding portion 54 provided in this manner allows to maintain the strength of the mounting member 50 even when it is taller than the formwork F. The holding portion 54 has an upper end surface that is also formed as a sloped surface. This allows to minimize the contact between the holding portion 54 and the leveling machine during the leveling process after concrete is poured into the formwork F. The mounting member 50 further comprises a plate spring portion 532 extended from the support portion 531 as in embodiment 1, which allows the fixing portion 53 of the mounting member 50 to serve as a clamping portion, and the mounting member 50 is easily mounted on the formwork F and firmly fixed thereto.

Figure 8A:
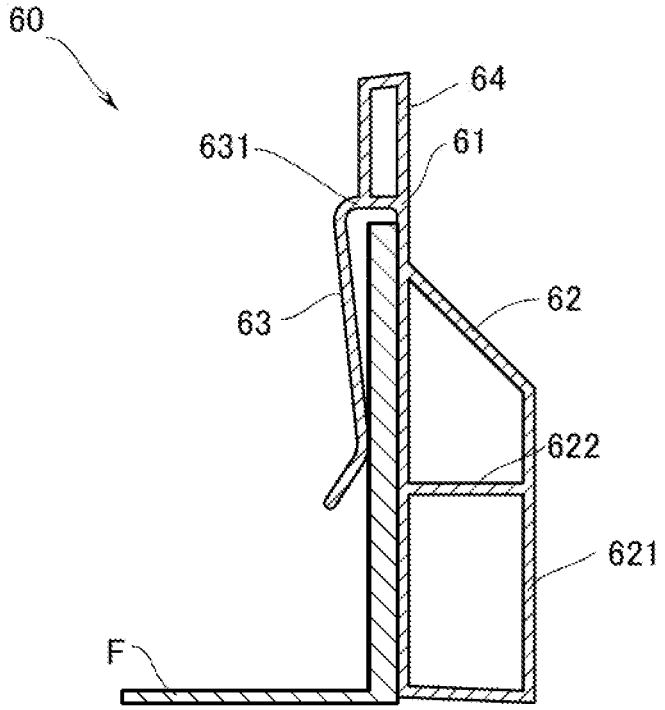
FIG. 8A.

Furthermore, a mounting member 60 shown in FIG. 8A comprises a ridge portion 62 provided at the bottom of the base material 61 with respect to the height direction, as in the mounting member 40 shown in FIG. 6B. The mounting member 60 includes a fixing portion 63 that is a clamping portion having a support portion 631, and a holding portion 64 having a rectangular shape in cross-sectional view is provided at an upper portion of the support portion 631, as in FIG. 7. The ridge portion 62 of the mounting member 60 includes a reinforcing plate 622 between the base material 61 and a side wall portion 621 that constitutes the ridge portion 62. Providing the reinforcing plate 622 in this manner allows to maintain the strength of the ridge portion 62 having a trapezoidal shape in cross-sectional view.

Figure 8B:
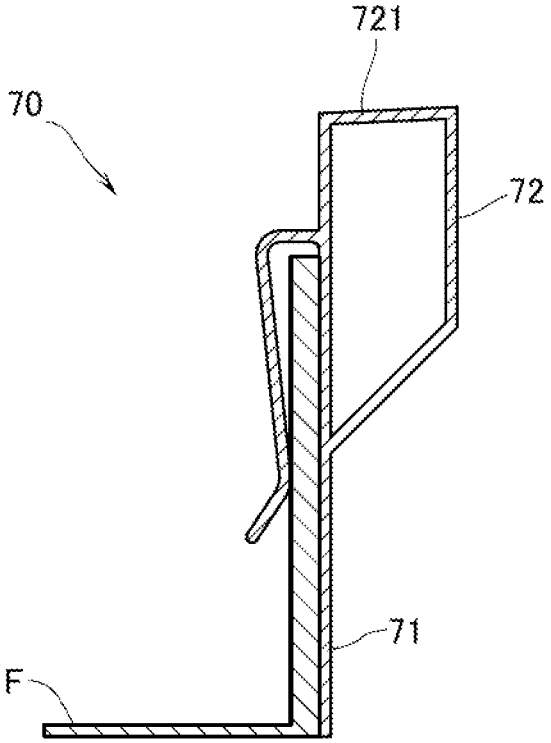
FIG. 8B.

Also, as shown in FIG. 8B, a mounting member 70 may comprise a ridge portion 72 that is provided at an upper portion of a base material 71 and trapezoidal in cross-sectional view. In this case, the ridge portion 72 is formed at a position higher than the formwork F, but the shape of the ridge portion 72 that is trapezoidal in cross-sectional view allows the ridge portion 72 to maintain sufficient strength even at a position where no formwork F provided. The ridge portion 72 of the mounting member 70 includes a ceiling portion 721. The ceiling portion 721 is configured to be a sloped surface when the mounting member 70 is mounted on the formwork F. This allows to minimize the contact between the mounting member 70 and the leveling machine during the leveling process after concrete is poured into the formwork F.

Figure 9:
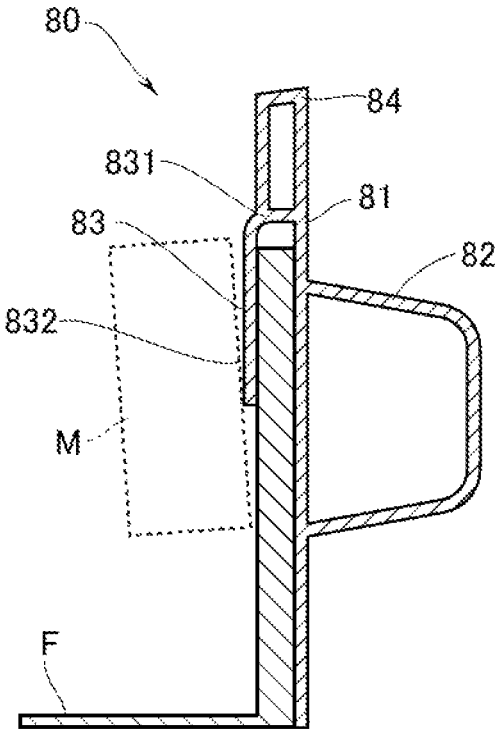
FIG. 9 shows mounting members according to modification examples, mounted on a formwork.

FIG. 9 shows a mounting member 80 as a modification example, which is similar to the mounting member 50 shown in FIG. 7 except for the shape of its fixing portion 83. Specifically, the mounting member 80 comprises a ridge portion 82 provided near the center of the base material 81 with respect to the height direction, in the same manner as the ridge portion 52, and a holding portion 84 that is rectangular in cross-sectional view like the holding portion 54 is provided at an upper portion of a support portion 831 of the fixing portion 83 provided in the base material 81. Here, the fixing portion 83 includes the support portion 831 and an extended portion 832 extended vertically downward from the support portion 831. Unlike the plate spring portion 122, the extended portion 832 does not have a pressing portion 123 and is parallel to the base material 81, i.e., keeps a constant distance from the base material 81. The gap between the extended portion 832 and the base material 81 substantially corresponds to the thickness of the formwork F, and the formwork F is inserted between the extended portion 832 and the base material 81.

In the case of the mounting member 80 of this modification example, the fixing portion 83 does not serve as a clamping portion unlike the mounting member 50 and the like, and thus to assist the fixation, a magnet M may also be provided to fix the mounting member 80 to the formwork F from the outside. In other words, the mounting member 80 may further comprise the magnet M that is adhered to the formwork F by means of the mounting member 80, thereby firmly fixing the mounting member 80 to the formwork F. The formwork F includes a ferromagnetic body and the extended portion 832 keeps a constant gap from the base material 81, and thus the mounting member 80 is fixed to the formwork F from the outside by means of the magnet M, which allows to fix the mounting member 80 more firmly.

As shown in FIG. 9, the magnet M is sized to be longer in the direction of its extension than the extended portion 832. Although the magnet M may be sized to cover only the extended portion 832, when the magnet M is sized to be longer in the direction of its extension than the extended portion 832, some area of the magnet M is directly adhered to the formwork F, and thus the mounting member 80 is fixed more securely and firmly. In this case, it is recommended that firstly the lower side of the magnet M be directly adhered to the formwork F, and its upper side be adhered to the formwork F by means of the mounting member 80 with the lower side of the magnet M adhered. The magnet M may be a plurality of magnets that are shorter than the longitudinal length of the formwork F and provided parallel to each other along the longitudinal direction, or a single magnet that corresponds to the longitudinal length of the formwork F.

The present invention is not limited to the embodiments and modification examples described above. For example, although the plate spring portion 121 is used as a clamping portion in embodiment 1, the present invention is not limited to this, and a plurality of clip portions using springs may be provided. Also, although the mounting members 10 to 80 of the embodiments described above cover the formwork F in the height direction, the present invention is not limited this, and the mounting member may not cover the formwork F in the height direction. Furthermore, it is of course possible to combine the technical features of the embodiments and modification examples as required. For example, the magnet M of the mounting member 80 may also be used for the mounting members 30 and 40 to fix the fixing portions 33 and 43 to the formwork F from the outside.

In embodiment 1 described above, the connecting portion 132 and the like are removable as they are thinner than the other portions of the first ridge portion 13 and the second ridge portion 14, but the present invention is not limited this. For example, some area of the connecting portion 132 and the like may be formed of resin of lower strength so that they are easily removed. The base material 11 does not have to be a single base material having a longitudinal length that is equal to the longitudinal length of a side of the formwork F on which it is disposed, and a plurality of mounting members may be provided parallel to each other.

What is claimed is:

1. A mounting member that is mounted on a formwork used to fabricate a concrete member, the mounting member comprising:

a base material;

a ridge provided on the base material projecting away from an inner surface of the formwork;

a fixing portion including a support and a downwardly extending portion, the support extending away from the base material at a position above an upper end of the formwork, the downwardly extending portion extending downwardly from the support over a side of the formwork opposite from the inner surface and fixing the ridge to the inner surface; and a holding portion connected above the support and having a rectangular cross-section, wherein one side of the rectangular cross-section is an extension of the base material above the position from which the support extends away from the base material, another side of the rectangular cross-section being connected to the support adjacent to a position on the support from which the downwardly extending portion starts extending downwardly from the support, and an upper end surface of the holding portion in the rectangular cross-section is at a height higher than a height of the support.

2. The mounting member according to claim 1, wherein the fixing portion is a clamping portion that clamps the formwork.

3. The mounting member according to claim 1, wherein the ridge includes a base area having a portion that is thinner than the other portions of the ridge.

4. The mounting member according to claim 1, wherein the mounting member comprises an upper end portion that is sloped.

5. The mounting member according to claim 1, wherein the fixing portion has an adhesive surface.

6. The mounting member according to claim 1, wherein the formwork including a ferromagnetic body and the fixing portion including a magnet disposed between the formwork and the mounting member.

7. The mounting member according to claim 1, wherein the fixing portion includes a plate spring portion and the support supports one end side of the plate spring portion, and the support is provided at a position at which it does not make contact with an upper end surface of the formwork when the mounting member is mounted on the formwork.

8. The mounting member according to claim 1, wherein the support has a base area that is flat.

9. The mounting member according to claim 1, wherein the fixing portion includes an extended portion that is extended parallel to the base material and the support connects and supports the extended portion and the base material.

10. The mounting member according to claim 1, wherein the formwork includes a ferromagnetic body and the mounting member further comprises a magnet that is adhered to the formwork by means of the mounting member.

* * * * *